US006584980B1

(12) United States Patent
Russo

(10) Patent No.: US 6,584,980 B1
(45) **Date of Patent: *Jul. 1, 2003**

(54) TOBACCO PRODUCTS WITH STABILIZED ADDITIVES HAVING VITAMIN E ACTIVITY

(75) Inventor: Joseph D. Russo, Palo Alto, CA (US)

(73) Assignee: Rousseau Research, Institute, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/580,032

(22) Filed: May 26, 2000

Related U.S. Application Data

(63) Continuation-in-part of application No. 09/064,021, filed on Apr. 21, 1998, now Pat. No. 6,079,418, which is a continuation-in-part of application No. 09/020,958, filed on Feb. 9, 1998, now Pat. No. 6,082,370.

(51) Int. Cl.[7] ..... A29F 47/00

(52) U.S. Cl. ..... 131/347; 131/360; 131/364; 131/365; 131/275; 131/276

(58) Field of Search ..... 131/276, 277, 131/275, 290, 291, 200, 347, 335, 342, 352, 364, 365

(56) References Cited

U.S. PATENT DOCUMENTS

| | | | | |
|---|---|---|---|---|
| 3,339,558 | A | | 9/1967 | Waterbury |
| 3,667,478 | A | | 6/1972 | Waterbury |
| 4,516,588 | A | | 5/1985 | Rudolph et al. |
| 5,016,655 | A | | 5/1991 | Waddell et al. |
| 5,046,514 | A | * | 9/1991 | Bolt |
| 5,048,546 | A | | 9/1991 | Hsu et al. |
| 5,084,563 | A | | 1/1992 | Sakai et al. |
| 5,371,245 | A | | 12/1994 | Rindone et al. |
| 5,829,449 | A | | 11/1998 | Hersh et al. |
| 5,944,026 | A | | 8/1999 | Kopsch et al. |
| 6,138,683 | A | * | 10/2000 | Hersh et al. ..... 131/347 |

FOREIGN PATENT DOCUMENTS

| | | | |
|---|---|---|---|
| EP | 0 550 337 A1 | | 7/1993 |
| EP | 0 770 577 A1 | | 5/1997 |
| GB | 2 212 722 A | | 2/1989 |
| JP | 62-232371 | * | 10/1987 |
| WO | WO 95/28098 | | 10/1995 |
| WO | WO 97/25876 | | 7/1997 |

OTHER PUBLICATIONS

Wiernik et al., *Effect of Air–Curing on the Chemical Composition of Tobacco*, Svenska Tobaks AB, Department Reserca, S–118 84 Stockholm, Sweden (Tobacco Chemist's Research Conference, Sep. 1995).

* cited by examiner

*Primary Examiner*—Steven P. Griffin
*Assistant Examiner*—Carlos Lopez
(74) *Attorney, Agent, or Firm*—Townsend and Townsend and Crew LLP; Guy W. Chambers

(57) ABSTRACT

A substantially pure stabilized compound having Vitamin E activity is added to smokable or smokeless tobacco or non-tobacco products to achieve less irritation and antioxidant benefits. In a preferred embodiment, a substantially pure "dry" powdered ester analog of Vitamin E, such as Vitamin E acid succinate, Vitamin E acetate or d-alpha-tocopheryl polyethylene glycol 1000 succinate is mixed directly with the tobacco during the curing or manufacturing process. For cigarette applications, these Vitamin E compounds can also be inserted into a cigarette filter, holder and/or paper, either in powdered form or in microencapsulated form. Although not preferred, a common oily form of Vitamin E can be used in the present invention so long as it is stabilized and does not ruin the appearance and function of the tobacco or non-tobacco products.

19 Claims, 1 Drawing Sheet

TOBACCO PRODUCTS WITH STABILIZED ADDITIVES HAVING VITAMIN E ACTIVITY

This is a continuation-in-part of U.S. application Ser. No. 09/064,021, entitled "Tobacco Products With Dry Powdered Vitamin E", filed April 21, 1998 and now U.S. Pat. No. 6,079,418 which was itself a continuation-in-part of U.S. application Ser. No. 09/020,958, entitled "Cigarette With Dry Powdered Vitamin E", filed Feb. 9, 1998 now U.S. Pat. No. 6,082,370.

TECHNICAL FIELD OF THE INVENTION

The present invention relates to smoking tobacco products, such as cigarettes, cigars, pipe tobacco (bulk), roll your own tobacco and smokeless tobacco products, also known as "snuff" or "chewing tobacco" and non-tobacco smokable or mouthable products. More particularly, a novel form of smokable cigarette, cigar and bulk tobacco, including cured and uncured leaves, non-tobacco smokables or mouthables and smokeless tobacco is disclosed which includes as additives one or more stabilized health enhancing compounds that exhibit Vitamin E activity.

BACKGROUND OF THE INVENTION

Health problems associated with cigarette smoking, cigar smoking, pipe smoking and smokeless tobacco have been well publicized. In various scientific studies, cigarette smoking, cigar smoking, pipe smoking and use of smokeless tobacco have been causally linked to diseases such as lung, throat, mouth and other cancers as well as emphysema, smoker's cough and heart disease.

Various attempts have been made to address cigarette health problems through reformulation of cigarettes. For example, special blends of tobacco have been formulated for cigarettes with reduced levels of tar and nicotine. Unfortunately, each reduction of the tar and nicotine level has been accompanied by a corresponding reduced level of smoker satisfaction requiring unhealthy longer, stronger puffs to increase smoker's satisfaction. As such, sales of lowered tar and nicotine cigarettes, particularly those commercially classified as "ultra low tar and nicotine", have not lived up to expectations. More recently, efforts have been made to altogether remove additives from cigarettes. While such "additive free" cigarettes may provide a purer tobacco smoke, it is unclear whether they provide any corresponding health benefits. In fact, in some cases, they have been shown to be stronger in tar and nicotine since they contain relatively more tobacco than non-additive containing cigarettes.

Attempts have also been made to insert additives into cigarettes to offset some of the hazardous substances present in tobacco. For example, U.S. Pat. No. 5,016,655 ("'655 patent") recommends insertion of alcohols into the tobacco or filters of cigarettes in order to neutralize the carcinogenic effect of N-nitrosamines, such as N'-Nitrosonoronicotine (NNN). According to the '655 patent, these alcohols can be advantageously packaged with other chemicals such as Vitamins A, B, C and E. Nonetheless, in Table IV of the '655 patent, it is taught that use of Vitamin E as a stand-alone additive (i.e., apart from an alcohol mixture) is ineffective in neutralizing NNN.

Similarly, in U.S. Pat. No. 5,944,026 and its companion published PCT application Ser. No. WO 95/28098, it is suggested that cigarette additives can be formed from a complex of eukaryotic cell cultures with Vitamin E or a liquid solution of natural substances of plant origin having anti-mutagenic and aromatizing properties also with Vitamin E. Nonetheless, there is no suggestion in this PCT publication that Vitamin E can have any efficacy as a stand-alone additive for cigarettes or should be used apart from such liquid solutions.

In U.S. Pat. Nos. 3,339,558 ("'558 patent") and 3,667,478 ("'478 patent"), Vitamin A is recommended as a primary cigarette additive to promote better health. The '558 patent teaches that the Vitamin A should be inserted within the cigarette filtering medium in rupturable capsules, while the '478 patent teaches that a stabilized aqueous emulsion of active Vitamin A should be applied to the tobacco in a cigarette. The '478 patent indicates that other vitamins, such as Vitamins C, D, E etc., can be added to the Vitamin A emulsion but does not suggest that any of the other vitamins can be advantageously used as a stand-alone additive.

In a paper presented to a tobacco symposium, researchers reported an experiment involving vacuum infiltration of alpha-tocopherol during the tobacco air curing process. Wiernik et al., Effect of Air-Curing On The Chemical Composition Of Tobacco, Svenska Tobaks AB, Department Reserca, S-118 84 Stockholm, Sweden (Tobacco Chemist's Research Conference, September 1995). While some beneficial effects were noted, the alpha-tocopherol diminished in concentration by 25% during the short curing process. As such, it does not appear that a stabilized form of alpha-tocopherol was used for this experiment.

As noted, none of this prior art suggests the use of stabilized Vitamin E, a stabilized Vitamin E analog or a stabilized Vitamin E active derivative as a stand-alone tobacco or non-tobacco product additive, much less what forms, quantities and delivery mechanisms should be used for such a stand-alone Vitamin E type additive.

SUMMARY OF THE INVENTION

The present invention provides an effective technique for adding a stabilized, substantially pure compound having Vitamin E activity to cigarettes, cigars, bulk tobacco (including leaves), reconstituted tobacco, pipe tobacco and smokeless snuff or "chewing" tobacco(as smokeless tobacco is commonly known) as well as to non-tobacco smokable and mouthable products. In smokable tobacco and smokable non-tobacco products, such substantially pure Vitamin E active additives have been unexpectedly found to achieve a much less irritating smoke to the mouth, throat and lungs along with Vitamin E's antioxidant benefits. This beneficial effect may also apply to the second hand smoke irritation commonly experienced by non-smokers. In smokeless tobacco, substantially pure Vitamin E active additives have been unexpectedly found to reduce irritation to the cheeks, gums, palette, throat and esophagus.

In a preferred embodiment, a substantially pure, "dry" powdered analog of Vitamin E, known as d-alpha tocopheryl acid succinate or Vitamin E acid succinate, is mixed directly with the tobacco used in smokable or smokeless tobacco during the manufacturing process or directly into smokable non-tobacco products. This Vitamin E analog can also be inserted or mixed into mixtures of lamina tobaccos, reconstituted tobacco and lamina tobacco mixed with reconstituted tobacco as well as into a cigarette filter, holder, paper or wrapper. One may also place the additive in tobacco prior to curing so long as it will remain stable enough to sustain its benefits all the way through processing and in storage. Other preferred "dry" forms of Vitamin E analog which can advantageously be used with the present invention are forms of d-alpha tocopheryl acetate, d-alpha-tocopheryl polyethylene glycol 1000 succinate, d-alpha tocopherol, dl-alpha-tocopherol or natural mixed tocopherols which are spray dried on a suitable carrier (e.g., gelatin or gum acacia). Although not preferred, a common clear, viscous oily form of natural Vitamin E (d-alpha tocopherol) or its liquid analogs can be used in the present invention so long as it is used in a way that is stabilized so as not to oxidize, metabolize or ruin the appearance and function of the cigarette. This stabilization can be accomplished through chemical micro-encapsulation or diffusing in discrete particles into the tobacco or non-tobacco product, filter or paper.

DESCRIPTION OF THE SPECIFIC EMBODIMENTS

Figure 1:
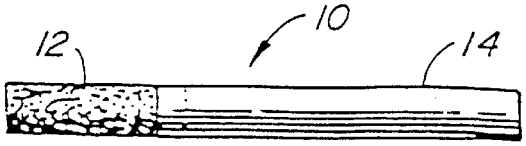
FIG. 1 shows a side elevation view of a typical cigarette.

"Vitamin E" or d-alpha tocopherol, as well as its analogs and derivatives, has been found to act as an anti-inflammatory and an antioxidant which can deactivate cell-damaging free radicals. Free radicals are chemical species that steal electrons from normal molecules. The damaged, once normal molecule then becomes a free radical setting off a chain reaction. At the biocellular level, lipids, proteins, enzymes, sugars and most importantly DNA become damaged by such free radicals and can cause harm including cellular abnormalities and disease. Strong cellular irritation from free radicals and harsh chemicals released from tobacco and non-tobacco plant materials used in a tobacco manner represent an assault on bodily tissues.

The range of compounds that exhibit health enhancing Vitamin E activity is described in U.S. Pat. No. 4,550,183 ("'183 patent"). According to the '183 patent, these compounds showing Vitamin E activity are a distinct series of compounds which are all derivatives of chroman-6-ol. These compounds are all tocol derivatives having an isoprenoid C16 side chain, including those compounds having an unsaturated C16 side chain. The term "tocol" is used to mean 2-methyl-2-(4',8',12'-trimethyltridecyl) chroman-6-ol. Alpha-, beta-, gamma-, and delta-tocopherols are of primary importance for Vitamin E activity, and are commercially isolated from various natural sources. Also important are the enols such as tocodienols and tocotrienols which are tocopherol compounds having an unsaturated side chain. Moreover, according to PCT application No. WO 95/22169, new alkylated sulphonium alkylene derivatives of 2H-1-benzopyran(s) have been taught to be tocopherol analogs that exhibit Vitamin E activity and are free radical scavengers.

Based upon the descriptions of compounds exhibiting Vitamin E activity provided in these references, the scope of tocopherols, their analogs and derivatives covered herein are all those compounds which are chroman-phytal compounds, both saturated and unsaturated, their stereoisomers and/or the foregoing compounds esterified, and/or adjuncts to all the aforementioned compounds that enhance or preserve their efficacy.

In commercial use, Vitamin E is most commonly obtained in a viscous, oily form from vegetable oil distillates. Vitamin E is then used in this oily form by either applying it directly to skin tissue or taking it orally in a capsulated daily vitamin supplement.

While the common oily form of Vitamin E may be acceptable for many uses, it presents problems when applied to the modified smokable products or smokeless products of the present invention. For example, if common oily Vitamin E is applied directly to a cigarette, it will have a tendency to migrate and ooze into the cigarette paper and thereby ruin the feel and appearance of the cigarette. Also, the common oily form of Vitamin E will have a tendency to interact with tobacco and other natural ingredients in a way that may detrimentally affect the stability of the Vitamin E. It is for these reasons that "dry" analogs of Vitamin E are preferred for the present invention in order to best maintain a clean feel and appearance for the smokable and smokeless tobacco and non-tobacco products as well as preserving the stability of the Vitamin E activity.

In order to gain stability for liquid forms of Vitamin E, one should micro-encapsulate, spray dry or accomplish a similar form change to render the liquid Vitamin E stable and dry. This can also be done by esterifying Vitamin E liquids, thereby blocking the active antioxidant site with a combinable acid. Combustion, heat or enzymes that occur in the use of the products of the instant invention can then dissociate the acid from the ester yielding free, fully active Vitamin E at the point of use.

One "dry" ester analog of Vitamin E that is preferred for the present invention is known variously as d-alpha tocopheryl acid succinate, Vitamin E acid succinate, 2R,4'R,8'R-alpha-tocopheryl acid succinate, d-alpha-tocopheryl hydrogen succinate and 2,5,7,8-Tetramethyl-2-(4',8',12'-trimethyltridecyl)-6-chromanol acid succinate. Vitamin E acid succinate has an empirical formula of $C_{33}H_{54}O_5$ and a molecular weight of 530.79. The chemical structure of Vitamin E acid succinate is as follows:

1

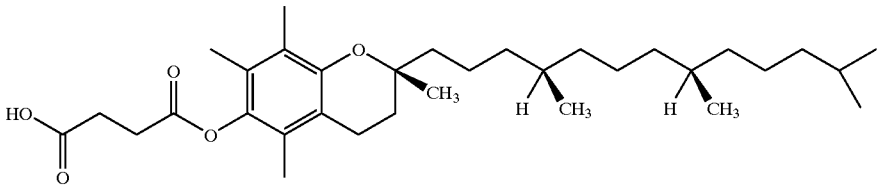

Vitamin E acid succinate is a succinate derivative of d-alpha tocopheryl in the form of a white to off-white crystalline powder with little or no odor or taste. Vitamin E acid succinate can be prepared by the vacuum distillation and succinylation of edible vegetable oil products. Vitamin E acid succinate can be commercially obtained from the Eastman Chemical Corporation of Kingsport, Tenn. as Eastman product PM4009 or E-1210. Vitamin E acid succinate can also be commercially obtained from the Henkel Corporation of LaGrange, Ill. as COVITOL® 1210 or from the Archer Daniels Midland Company of Decatur, Ill.

Another "dry" ester analog of Vitamin E that is preferred for the present invention is a spray dried, carrier based form of Vitamin E known variously as d-alpha tocopheryl acetate, Vitamin E acetate, 2R,4'R,8'R-alpha-tocopheryl acetate, and 2,5,7,8-Tetramethyl-2-(4',8',12'-trimethyltridecyl)-6-chromanol acetate. This alternative "dry" form of Vitamin E is also typically derived from vegetable oils and then spray dried onto a suitable carrier such as gelatin or gum acacia. Vitamin E acetate has an empirical formula of $C_{31}H_{52}O_3$ and a molecular weight of 472.75. The chemical structure of Vitamin E acetate is as follows:

2

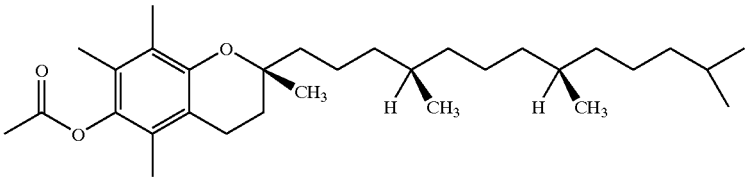

The preferred "dry" form of Vitamin E acetate is an acetate derivative of d-alpha tocopheryl in the form of a water-dispersible, fine powder containing d-alpha tocopheryl acetate spray-dried in a surface treated carrier. It is light tan in color with a bland odor and taste. Vitamin E acetate spray dried onto a gelatin carrier can be commercially obtained from the Archer Daniels Midland Corporation as product E-700. It can also be commercially obtained from the Henkel Corporation of LaGrange, Ill. as COVITOL® 700WD, a form of Vitamin E acetate which is spray dried onto a carrier of gum acacia.

Other dry, Vitamin E esters of the present invention available are linoleate and nicotinate. These are mostly used in cosmetics. A special, water soluble derivative form of Vitamin E is d-alpha-tocopheryl polyethylene glycol 1000 succinate. In this case, the succinate ester has been chemically modified to attach polyethylene glycol. Polyethylene glycol ("PEG") adjuncts to the succinate can be varied, possibly up to PEG 20,000 molecular weight for harder, smoother flowing powders. This PEG form, known as "TPGS" results in greater bodily absorption in persons, organs or plant matter that are not able to absorb the normal fat-soluble forms of Vitamin E. This should also be the case in the tobacco curing process where the leaves would more readily absorb analogs that have water soluble adjuncts yet still remain stable. The chemical attachment of various desirable compounds to esters of Vitamin E can make interesting derivatives to maximize the benefits of the Vitamin E activity. For example, ascorbic acid is too weak an acid to form an ascorbate ester with alpha-tocopherol. Partial attachment may be possible, however, to yield a Vitamin E derivative that delivers Vitamin E and ascorbic acid simultaneously in the instant invention. This would enhance efficacy during tobacco curing and mediation of the chemical assault that smokable and smokeless tobacco or non-tobacco smokables produce.

Other "dry" forms of Vitamin E which are suitable for the present invention and can be obtained from Henkel Corporation include COVITOL® F-350M and COV-OXS T-30P. COVITOL® F-350M is a cream colored powder containing mixed natural tocopherols (i.e., including the α-, β-, γ- and δ- forms of tocopherol), spray dried on a carrier of gelatin, dextrin, and glucose that is surface treated. Taste and odor of COVITOL® F-350M is bland to mild. COV-OX® T-30P is a light color powder which also contains "natural mixed tocopherols" (i.e., including the α-, β-, γ- and δ- forms of tocopherol), spray dried on a carrier of gum acacia. Like COVITOL® F-350M, the taste and odor of COV-OX® T-30P is bland to mild. As another "dry" alternative, a synthetic form of Vitamin E, namely dl-alpha-tocopherol, which is spray dried onto a suitable carrier (e.g., gelatin or gum acacia) can be advantageously used for the present invention.

Figure 2:
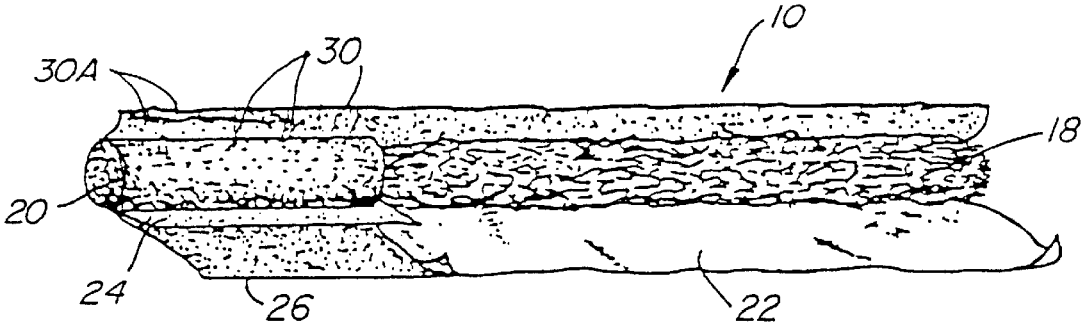
FIG. 2 shows a cutaway side elevation view of the typical cigarette of FIG. 1.

The preferred "dry" forms of Vitamin E can be incorporated into a tobacco or non-tobacco product in a number of different ways including being directly mixed with the tobacco or inserted into the cigarette filter, holder or paper, either in its powdered form, spray dried form or in microencapsulated form. These methods of incorporation can best be explained in connection with the drawings. Referring now to FIG. 1, a typical form of cigarette 10 is shown which includes a filter section 12 and a tobacco section 14. A cutaway view of this typical cigarette is shown in FIG. 2, where the tobacco rod 18, filter 20, tobacco paper 22, plug wrap 24 and filter paper 26 can be more clearly seen.

In one embodiment of the present invention, a substantially pure, "dry" form of Vitamin E can be blended into, sprayed or dusted onto the full or cut tobacco or non-tobacco leaves during the curing or manufacturing process. In that way, the substantially pure, "dry" form of Vitamin E will already be incorporated onto the tobacco when it is rolled into the cigarette shown in FIGS. 1 and 2 or packaged in a bulk smokeless container. While the quantity of Vitamin E to be used in this process can vary, it is expected that between 0.1 and 5000 milligrams of Vitamin E or Vitamin E analog would be a suitable amount for a cigarette or smokeless tobacco wad containing 400–1200 milligrams of tobacco, with a more preferred amount of Vitamin E or Vitamin E analog to be between 0.1% to 20.0% by weight of tobacco or 0.4 milligrams to 240 milligrams for a cigarette or smokeless tobacco wad containing 400–1200 milligram of tobacco.

In a second embodiment, the "dry" form of Vitamin E can be incorporated into the cigarette filter 20 either as dispersed powder particles 30, liquid infused into the filter medium or microencapsulated powder particles 30A. Such powdered particles 30 or microencapsulated powdered particles 30A could also be incorporated into tobacco paper 22, plug wrap 24 and/or filter paper 26. Up to 50% of the weight of these non-tobacco items could contain the Vitamin E active analog or derivative.

Figure 3:
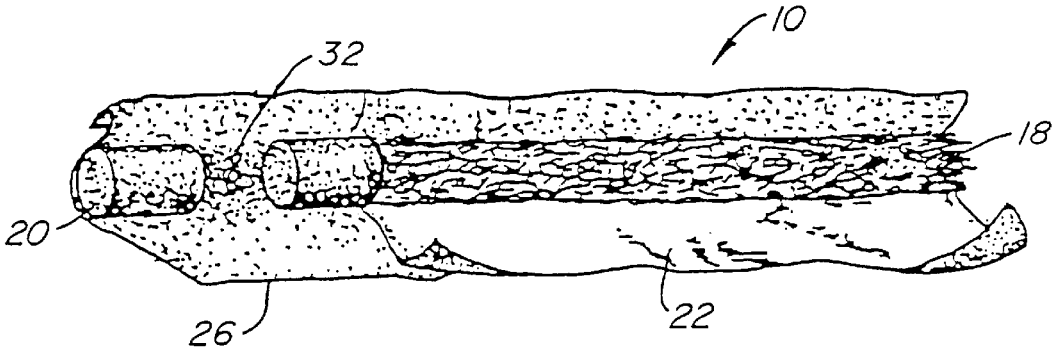
FIG. 3 shows a cutaway side elevation view of an alternative form of cigarette which can accommodate a filter insert.
Figure 4:
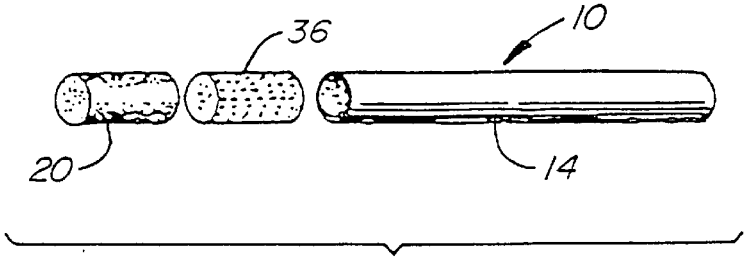
FIG. 4 shows a cutaway side elevation view of a second alternative form of cigarette which can accommodate a filter insert.

Referring now to FIG. 3, an opening 32 is shown in the middle of the filter 20 which can accommodate concentrated Vitamin E or Vitamin E analog in either powdered form or encapsulated form. Alternatively, as shown in FIG. 4, a Vitamin E or Vitamin E analog insert 36 could be made in the filter section between the actual filter 20 and the tobacco section 14. This insert 36 might contain an encapsulated Vitamin E compound or suitably wrapped powdered Vitamin E compound (e.g., wrapped in paper). Similarly, a narrower Vitamin E insert (not shown) could be incorporated into the tobacco section 14 of the cigarette. Likewise, Vitamin E infused reconstituted tobacco could be added to the tobacco blend.

Microencapsulation can be used in the present invention as a suitable delivery device for a Vitamin E compound in its preferred "dry" form or more common oily form. Microencapsulation initially isolates the Vitamin E compound and provides for its controlled release so that, for a smokable tobacco product, it can interact with its smoke stream environment. The shell wall microencapsulation construction should be sufficiently compatible with the Vitamin E compound contained therein to retain the Vitamin E compound until such time as the heat of the smoke causes the shell to open. In other words, the microcapsule is stable within the cigarette until it is smoked. At that point, the smoke's heat triggers the release of the Vitamin E compound.

Ideally, the shell wall should comprise between 20% and 50% of capsule volume for stability so as to resist rupture in the making, packing and consumer handling of the cigarette. The microcapsules should be 3 to 10 microns in circumference when placed on the cigarette paper 22, 24, 26 or mixed with the tobacco 18 so as to avoid undesired bumpiness on cigarette paper or to remain invisible if placed in the tobacco. Larger circumferences up to 50 microns are acceptable if the microcapsules are placed in the cigarette filter. Moreover, the capsules can be dyed with suitable food dyes to match the color of the filter or tobacco.

This Vitamin E microencapsulation can be accomplished by a shell wall construction referred to as the M-CAP Process of Insulation Technologies Corporation of Darby, Pennsylvania. The general specification of the M-CAP shell walls are capsules as small as three microns with melt temperatures of 64° F. to 650° F. The encapsulation material of the shell wall can be ELVAX™ (ethylene/vinyl acetate copolymers) or a similar cellulite material having the desired characteristics of a suitable shell wall release temperature between 64° F. and 650° F. ELVAX™ is an ethylene vinyl acetate resin, such as described in the "Material Safety Data Sheet—VAX001," dated Oct. 20, 1986, of E.I. DuPont de Nemours & Co. of Wilmington, Del.

Other shell wall candidates include BERMOCOLL™ which is an ethylhydroryethylcellulose manufactured by Berol Kemi AB of Stenungsund, Sweden; K&K Gelatin, which is a gelatin manufactured by the Kind & Knox division of Knox Gelatine, Inc. of Saddle Brook, N.J.; N-LOK™, which is an emulsion stabilizing material of National Starch and Chemical Corporation of Bridgewater, N.J.; and CAPSUL™, a modified starch material, which is described in "Product Data: Bulletin No. 409" of National Starch and Chemical Corporation of Bridgewater, N.J. In the case of a smokeless tobacco product, the enzymatic solubility to saliva of the powdered form of Vitamin E releases the active ingredients. In the case of the stabilized, oily form of Vitamin E, saliva will leach Vitamin E out along with other components of the smokeless tobacco product.

Aside from microencapsulation, use of the common oily form of Vitamin E is only recommended for the present invention where it introduced so as not to soak through the cigarette papers 22, 24, 26 or agglomerate smokeless tobacco. This might be best accomplished by applying the oily form of Vitamin E to the tobacco leaves shortly after harvesting. As the tobacco leaves are then taken through their various drying stages, the oily form of Vitamin E will have a tendency to soak into the tobacco leaves and thereby be less likely to migrate. As previously noted, though, the common oily, viscous form of Vitamin E will have a tendency to interact with tobacco and other natural ingredients in a way that will detrimentally affect the stability of the Vitamin E. In other words, unless stabilized, the Vitamin E will have been destroyed. The process of applying Vitamin E to tobacco leaves is thus aided through use of one of the water soluble, dry stable forms of Vitamin E previously described, such as d-alpha-tocopheryl polyethylene glycol 1000 succinate.

EXAMPLE 1

A comparison was made between a normal filterless cigarette and a filterless cigarette modified to include a substantially pure, "dry" form of Vitamin E analog. For this comparison, 7.5 grams of CHESTERFIELD® tobacco were removed from a CHESTERFIELD® cigarette and mixed with 0.1 grams of Vitamin E acid succinate. The mixed tobacco blend was formed into a filterless cigarette using a Rizla auto rolling box. A control cigarette, without Vitamin E analog additive, was also formed using the same Rizla auto rolling box.

When smoked, the control cigarette was found to cause throat and lung irritation for both a smoker and non-smoker. By contrast, the cigarette with Vitamin E acid succinate had the same flavor when smoked but was found to cause no throat or lung irritation for both the smoker and non-smoker. A retest on these same samples after several days and again after several weeks showed the same results.

EXAMPLE 2

A second comparison was made between a normal filtered cigarette, a filtered cigarette with oily Vitamin E injected into the filter and oily Vitamin E injected into the length of the tobacco. In this second comparison, the control cigarette was a normal MARLBORO® cigarette. In two separate MARLBORO® cigarettes, oily Vitamin E was taken from a Vitamin E capsule with a syringe and injected into the filter of one cigarette and into the length of the tobacco of the other cigarette.

The three cigarettes where then lit with a butane lighter and three equal, alternating puffs were taken from each cigarette by a non-smoker. The control cigarette was found to irritate the non-smoker's lungs and induce coughing. The cigarette with Vitamin E in the filter was found to be less irritating but still induced an unpleasant lung reaction and a slight cough. The cigarette with Vitamin E along the length of the tobacco yielded no irritation. Moreover, the flavor of the Vitamin E tobacco cigarette gave the impression of having been enhanced. A retest on these same samples after several days demonstrated that the beneficial effect was gone, indicating the Vitamin E had oxidized/metabolized.

EXAMPLE 3

A third comparison was made between a normal wad of smokeless tobacco and a wad of smokeless tobacco modified to include a substantially pure, "dry" form of Vitamin E analog. For this comparison, 1.0 gram of unmodified SKOAL® long cut smokeless tobacco (i.e., snuff) was first placed in the mouth of a non-tobacco user between the cheek and gum. This unmodified smokeless tobacco produced a pleasant flavor but also a simultaneous burning sensation in the mouth, throat and esophagus which, along with an induced cough, forced the non-tobacco user to spit out the unmodified smokeless tobacco. To clear the burning sensation from his mouth, the non-tobacco user washed his mouth out with water. Nonetheless, the burning sensation persisted in the mouth and throat for over 5 minutes after the initial washing.

Approximately four hours later, long enough to ensure the sensitivity and the burning sensation had completely subsided, the non-tobacco user then mixed 0.1 grams of Vitamin E acid succinate obtained from the Eastman Chemical Corporation of Kingsport, Tenn. with 10.0 grams of SKOAL® long cut smokeless tobacco. A 1.0 gram wad of this Vitamin E modified smokeless tobacco was then placed in the mouth of the non-tobacco user between the cheek and gum. Like the unmodified snuff, this Vitamin E modified snuff produced a similar pleasant flavor. Nonetheless, unlike the unmodified smokeless tobacco, the Vitamin E modified smokeless tobacco was completely non-irritating.

In the foregoing specification, the invention has been described with reference to specific preferred embodiments and methods. It will, however, be evident to those of skill in the art that various modifications and changes may be made without departing from the broader spirit and scope of the invention as set forth in the appended claims. For example, the Vitamin E compounds of the present invention can be used not only in cigarettes but also in other tobacco products such as cigars or pipe tobacco as well as tobaccoless smoking products (e.g., cannabis cigarettes).In this regard, The National Academy of Sciences concluded in 1999 that cannabis can be effective medicine in treating chronic pain, nausea and AIDS related weight loss. The panel's one major criticism was the delivery system (i.e., the inhalation of harmful smoke). Like the cigarette applications which have been previously discussed, Vitamin E compounds could advantageously be mixed with cigar tobacco, pipe tobacco, smokeless tobacco or tobaccoless smoking and tobaccoless smokeless products during the manufacturing process. Alternatively, in the case of pipe tobacco, it could be mixed with the tobacco by the consumer before the tobacco mixture is loaded into a pipe. In the same manner, the consumer could add it to smokeless tobacco. For these reasons, the specification and drawings are, accordingly, to be regarded in an illustrative, rather than restrictive, sense; the invention being limited only by the appended claims.

What is claimed is:

1. A tobacco product comprising tobacco and between 0.1% and 20.0% by weight for said tobacco of a stabilized additive consisting essentially of tocopherols, tocopheryls, tocodienols, tocotrienols, their esters or a combination of one or more of them which additive is capable of vaporizing and/or disassociating in use.

2. The tobacco product of claim 1 in which said tocopheryl ester is a d-alpha-tocopheryl polyethylene glycol 1000.

3. The tobacco product of claim 1 in which said additive is selected from the group consisting of d-alpha-tocopherol, d-alpha-tocopheryl acid succinate, d-alpha-tocopheryl acetate, d-alpha-tocopheryl polyethylene glycol 1000 succinate, mixed tocopherols and dl-alpha-tocopherol.

4. The tobacco product of claim 1 in which said additive is d-alpha-tocopheryl acid succinate.

5. The tobacco product of claim 1 wherein said tobacco product is a leaf to be cured, a smokable tobacco product or a smokeless tobacco product.

6. The tobacco product of claim 1 wherein said product is a cigarette, cigar or bulk tobacco product.

7. A tobacco product comprising tobacco and a stabilized additive consisting essentially of dry powdered forms of tocopherols, tocopheryls, tocodienols, tocotrienols, their esters or a combination of one or more of them which additive is capable of vaporizing and/or disassociating in use.

8. The tobacco product of claim 7 wherein said additive is selected from the group consisting of d-alpha-tocopheryl acid succinate, d-alpha-tocopheryl polyethylene glycol 1000 succinate, d-alpha-tocopheryl acetate spray dried onto a suitable carrier, mixed tocopherols spray dried onto a suitable carrier and dl-alpha-tocopherol spray dried onto a suitable carrier.

9. The tobacco product of claim 7 wherein said tobacco product is smokeless tobacco.

10. The tobacco product of claim 7 wherein said tobacco product is a leaf to be cured, a smokable tobacco product or a smokeless tobacco product.

11. The tobacco product of claim 7 wherein said product is a cigarette, cigar or bulk tobacco product.

12. A cigarette comprising tobacco, cigarette rolling paper and a stabilized additive consisting essentially of tocopherols, tocopheryls, tocodienols, tocotrienols, their esters or a combination of one or more of them which additive is capable of vaporizing and/or disassociating in use.

13. The cigarette of claim 12 wherein said additive is applied to the tobacco.

14. The cigarette of claim 13 wherein said additive is applied to the tobacco during the curing process.

15. The cigarette of claim 12 wherein said additive is applied to or incorporated within said cigarette rolling paper.

16. The cigarette of claim 15 wherein said additive is up to 50% by weight of said cigarette rolling paper.

17. The cigarette of claim 12 further comprising a cigarette filter.

18. The cigarette of claim 17 wherein said additive is up to 50% by weight of said cigarette filter.

19. A smokeless tobacco product comprising tobacco and between 0.1% and 20.0% by weight for said tobacco of a stabilized additive consisting essentially of tocopherols, tocopheryls, tocodienols, tocotrienols, their esters or a combination of one or more of them which additive is capable of vaporizing and/or disassociating in use.

* * * * *